United States Patent [19]

Micallef

[11] Patent Number: 4,825,665

[45] Date of Patent: May 2, 1989

[54] COOLING BEVERAGES

[75] Inventor: Charles R. Micallef, Todmorden, England

[73] Assignee: Lune Metal Spinning Company Limited, Lancashire, United Kingdom

[21] Appl. No.: 64,379

[22] Filed: Jun. 22, 1987

[30] Foreign Application Priority Data

Dec. 19, 1984 [GB] United Kingdom ..... 8432006

[51] Int. Cl.[4] ..... F25D 3/08

[52] U.S. Cl. ..... 62/372; 62/381; 62/457.8; 62/463

[58] Field of Search ..... 62/457, 459, 463, 381, 62/62, 293, 372

[56] References Cited

U.S. PATENT DOCUMENTS

| | | | |
|---|---|---|---|
| 390,349 | 10/1888 | Delpy | 62/376 X |
| 450,199 | 4/1891 | Smith | 62/376 X |
| 592,781 | 11/1897 | Herfwig | 62/457 X |
| 2,323,308 | 7/1943 | Chamberlain | 62/376 X |
| 2,736,174 | 2/1956 | Tice | 62/457 X |
| 2,817,458 | 12/1957 | Amigone | 62/381 X |
| 2,838,916 | 6/1958 | Sola | 62/381 X |
| 4,078,397 | 3/1978 | Brande | 62/372 |
| 4,580,405 | 4/1986 | Cretzmeyer, III | 62/457 X |

FOREIGN PATENT DOCUMENTS

| | | | |
|---|---|---|---|
| 479696 | 4/1916 | France | 62/457 |
| 2168798 | 6/1986 | United Kingdom | 62/457 |

*Primary Examiner*—Lloyd L. King

*Attorney, Agent, or Firm*—Edwin E. Greigg

[57] ABSTRACT

A wine cooling apparatus comprises a bottle holder which holds a bottle within an ice and water mixture in a container which is rotatably mounted on a turntable. When the turntable is rotated, the container rotates and fins on the inside of the container stir the mixture and cause it to swirl around the surface of the bottle thereby cooling the wine.

10 Claims, 2 Drawing Sheets

COOLING BEVERAGES

Figure 1:
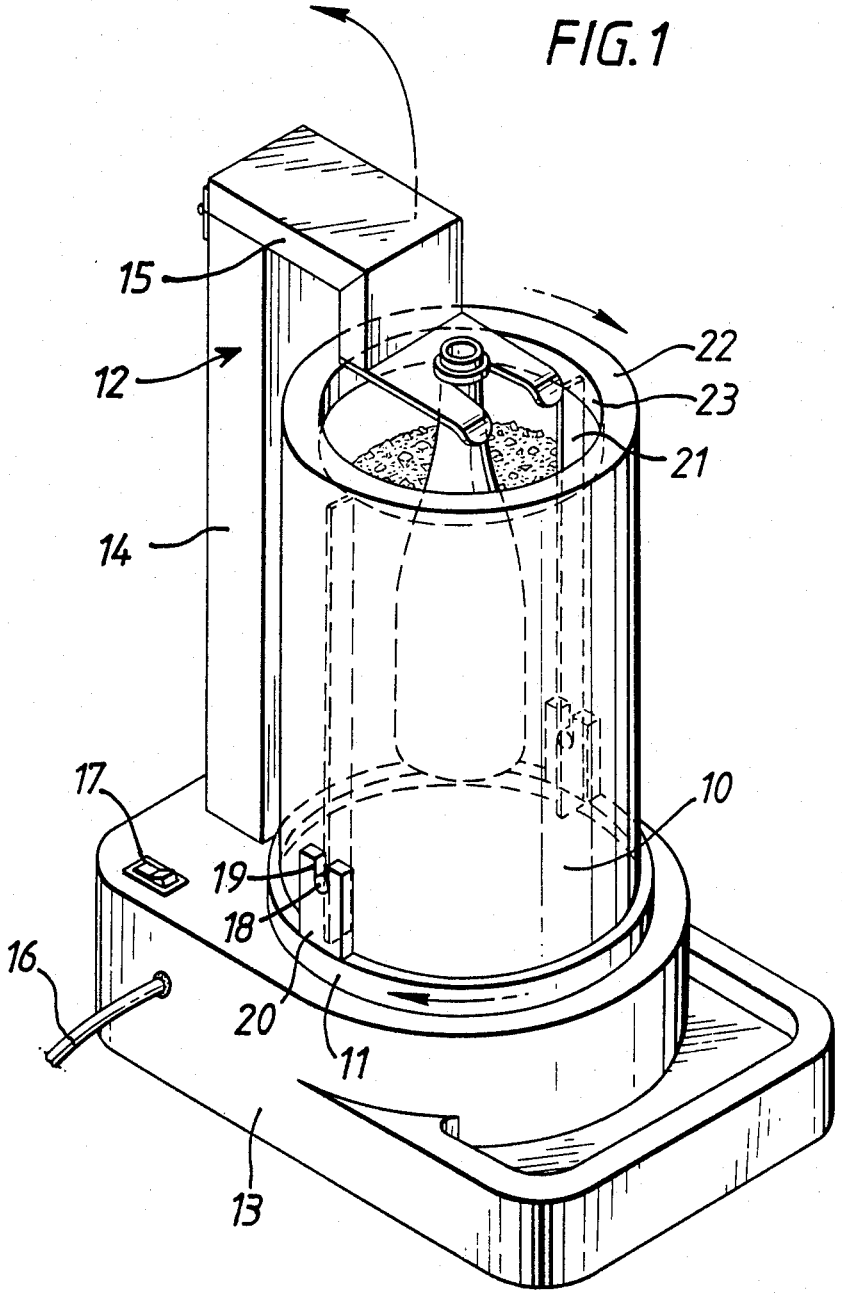

This invention relates to cooling beverages in containers and in particular, although not exclusively, to cooling wine in a bottle. The invention might also be applied to cooling cans of drinks, or jugs of drinks such as fruit juices.

With wine, and in particular white wine, it is often desired to serve the wine chilled or at a temperature below room temperature. Wine is sometimes stored in a refrigerator to allow it to be served chilled. However, when a large selection of wines is offered, or a large number of bottles is required to be served in a short period of time, the size of the refrigerator must be considerable if it is to cope with demand. Thus valuable space is often taken up by the refrigerator. Further, the storing of wine at a low temperature uses up a considerable amount of energy, a lot of which energy may be wasted if the wine being cooled is not used for some time. An additional disadvantage with a refrigerator is that it takes alongtime to cool a bottle, and thus is of no use where a customer orders a bottle of wine which is not yet chilled, as the customer is unwilling to wait while the wine is chilled gradually. The practice of maintaining wine for long periods in a refrigerator is also disadvantageous because it prevents natural ageing.

It has been known for people serving wine to attempt to cool the wine rapidly by placing it into a bucket of ice and rotating the bottle rapidly to and fro in the ice. Although the wine may well have its temperature reduced rapidly by this movement, any sediment is shaken up and the wine has bubbles forced into it by the movement which renders the wine unsuitable for drinking. Obviously this method of cooling cannot be used on sparkling wines as the pressure which builds up within the bottle by this movement does not permit the wine to be opened for a considerable period after the violent movement has ceased.

U.S. Pat. No. 3,888,092 (Fisher) discloses a wine chiller including a tank to hold the chilling medium and wine bottles to be cooled, a refrigeration unit to cool the chilling medium, a pump to draw the chilling medium cooled by the refrigeration until and feed it to the tank, and a receptacle to receive chilling medium as it overflows from the tank. Incorporation of a pump in the wine chiller means that ice/water mixture cannot be used as it cannot be pumped by the pump. As a result the chilling medium has to be a cooling medium above 0° C. and therefore efficient cooling cannot be achieved.

An object of this invention is to provide apparatus for cooling wine or other beverages in a container which can cool the beverage to a desired temperature of, say 9° C., in a few minutes. Another object of this invention is to provide apparatus for cooling a beverage, such as wine, in a container which can use an ice/water mixture as a cooling medium.

Briefly this invention comprises cooling a beverage in a container by holding the container in a cooling medium which is located in a receptacle, the preferred form of cooling medium being a mixture of ice and water, and acting directly upon the cooling medium in the receptacle whereby to cause the cooling medium to be swirled around the container so that the cooling medium is moved continually and is circulated around the container. The motion of the cooling medium around the beverage container causes the beverage in that container to be cooled at a rapid rate and, as the container is held while it is being chilled, the beverage is not shaken up and does not suffer the disadvantages associated with such movement of the container. Furthermore a container such as a wine bottle may be rapidly chilled after it has been ordered, thus avoiding or reducing the need to provide a large refrigeration space for stored. chillled bottles.

In a preferred embodiment the receptacle is caused to be rotated about the container whereby to cause the cooling medium to be swirled around the container which is held out of contact with the receptacle. There may be timing means arranged to allow movement of the cooling medium to cease at the end of a predetermined period of time. The inner wall of the receptacle may be adapted to cause movement of the cooling medium upon rotation of the receptacle, say by the inclusion in that inner wall of one or more fins projecting into the interior of the receptacle. Apparatus for carrying out the invention may be arranged to hold a plurality of containers of beverages in the receptacle for cooling simultaneously. The apparatus may be provided with a variable timer device, a digital display and a room temperature readout device to enable the appropriate choice of time etc., to be made.

The rotation of the receptacle may be arranged to be effected by an electric motor which may be an AC or a DC motor, and the timing means may be associated with the motor so as to switch off the motor after a predetermined time has elapsed. The speed of rotation of the receptacle, as well as the duration of the predetermined time for which the electric motor operates before it is switched off, may be adjustable.

Two containers may be provided each having a bottle support whereby a plurality of bottles may be chilled at any one time.

Figure 2:
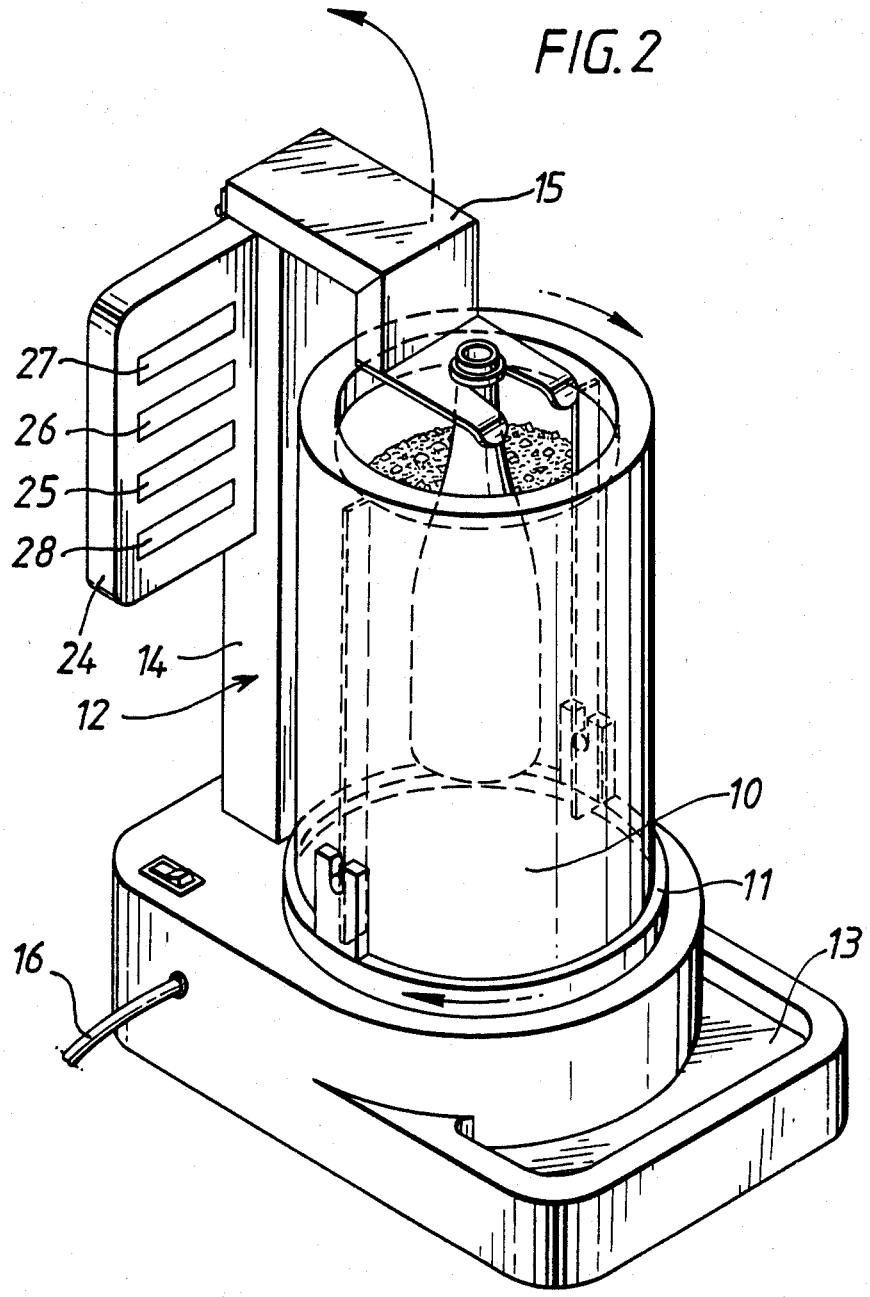

One embodiment of this invention, and a modification of that embodiment, will be described now by way of example with reference to the accompanying drawings, of which:

FIG. 1 is a perspective view of wine cooling apparatus in which this invention is embodied, and FIG. 2 is a perspective view of wine cooling apparatus similar to that shown in FIG. 1 but including a modification.

FIG. 1 shows wine cooling apparatus including a receptacle which is an open topped cylindrical drum 10 mounted on a turntable 11, and a bottle holder 12. The drum 10 has a plain interior surface with a level marking to indicate the level to which it is to be filled with cooling medium.

The turntable 11 is supported by a platform 13. The bottle holder 12 comprises a column 14 which is mounted on the platform 13 at one side of the turntable 11 and which projects upwardly alongside, but spaced from the drum 10. An arm 15 projects laterally from the top of the column 14 to which it is hinged and has a bottle engaging arrangement above the drum in the form of a pair of resilient fingers which are adapted to engage the neck of the bottle on opposite sides.

The platform 13 houses an electric motor (not shown) which is coupled to the turntable 11 to cause it to rotate at selected speed within the range 30–150 rpm.

The preferred speed is 60 rpm. The preferred coupling of the electric motor to the turntable is direct gearing but other rotary transmission arrangements may be used such as an indirect belt drive arrangement or a wheel driven by the motor and engaging the wall of the drum 10. An electric lead 16 is provided for connecting the electric motor to an AC power supply. An on/off switch 17 is mounted on the platform 13 and is operable to make or break the connection between the electric lead 16 and the electric motor for controlling the power supply to the electric motor.

A pair of lugs 18 extend from the outer cylindrical surface of the drum 10 and are ach located in a respective one of a pair of upwardly-open slots 19 which are formed in plates 20 mounted on the turntable 11 on opposite sides of the drum 10. The drum 10 is wedged between the plates 20. That wedging action and the cooperation of the lugs 18 with the sides of the slots 19 hold the drum 10 on the turntable 11 and constrain it to rotate with the turntable 11.

An opposed pair of radially inwardly projecting fins 21 are provided on the inner cylindrical surface of the drum 10, each fin 21 extending over substantially the full height of the drum 10.

The upper edge of the drum 10 is formed with an annular radially-inwardly projecting flange 22 which has a depending cylindrical flange 23 at its inner edges.

In use, the neck of a bottle is inserted between and gripped by the resilient fingers of the bottle holding arrangement. The major portion of the bottle extends into a cooling medium, comprising ice and water, which is contained within the drum 10. The on/off switch 17 is then actuated and the turntable 11 driven for rotation by the electric motor, thereby causing the drum 10 to be rotated. The fins 21 stir the ice and water mixture and cause it to be swirled around the bottle. As the mixture moves around the bottle, heat passes from the wine in the bottle, through the wall of the bottle and into the ice and water mixture. As the mixture is continually moving within the container no liquid of the mixture is permitted to remain in contact with the wall of a bottle for more than an instant. Thus no thermal barrier is allowed to build up adjacent to the bottle which would reduce the rate of cooling.

The inwardly-directed and depending annular flanges 22 and 23 prevent the mixture from rising up and over the side of the drum 10.

A timer which is operable to switch off the electric motor automatically after a predetermined time may be incorporated. Alternatively the motor may be stopped by manual operation of the switch 17. It has been found that, at a rotation speed of about 60 revs per minute wine can be chilled from a temperature of the order of 20° to 22° C. to 9° C. after the drum 10 has been rotated for between 5 and 6 minutes. A time/temperature chart in the form of a label stuck to a surface of the apparatus may be provided.

Once rotation of the drum 10 has ceased, the neck of the bottle can be removed from between the resilient fingers and the wine can be served.

The drum 10 may be removed from the turntable 11 in order to empty the mixture or pour in fresh mixture, by lifting the drum 10 until the lugs 18 are clear of the slots 19 in the plates 20.

The apparatus may be provided with alternative claw devices adapted for holding cans such as cans of beer or soft drinks, the claw devices being for fitting in place of the wine bottle holding device. Another alternative replacement device that might be provided is claw device for holding jugs of fruit juice.

All the parts of the apparatus may be formed of a suitable plastics material, or a suitable metal, or the apparatus may comprise metal and plastic parts.

FIG. 2 shows apparatus similar to that shown in FIG. 1 but modified by the provision of additional control means and a display control panel 24. The panel 24 has a room temperature display 25 which is a visual readout of the ambient temperature sensed by temperature sensing means (not shown) incorporated in the apparatus. There is a timer switch 26 which is operable to activate a timer to control operation of the turntable 11 automatically for a selected time interval up to a maximum of 15 minutes, the time interval being selectable in increments of half a minute. The timer switch 26 is also arranged to operate a warning light 27 and/or an audible warning device (not shown). The timer is adapted to stop the electric motor automatically at the end of the selected time interval. The control panel 24 also has an indicator 28 which reads out a selected number as an indication of the table in the restaurant, or of the waiter responsible.

The visual displays 25, 27 and 28 may be mechanical devices or micro electronic devices using LED means, LCD means, or a combination thereof.

The apparatus shown in FIG. 2 may be mounted on the top shelf of a trolley which is designed to hold wine bottles below that shelf.

The height of the drum 10 and its diameter would be chosen to suit. The height of the drum 10 has a significant effect on cooling, and, for cooling wine bottles, the height of the drum 10 would be of the order of 320 millimetres. The single bottle container shown in the drawings would have a diameter of the order of 180 millimeters, but drums having smaller diameters, say 160 millimeters, could be used. Drums with larger diameters, say up to 500 millimeters in diameter may be used for acommodating a plurality of wine bottles or cans and drums of various heights may be adopted having regard to the form of container for which they are designed.

The fins 21 and the annular flanges 22 and 23 are optional although the latter are preferable for multicontainer applications in order to prevent the cooling medium splashing out of the drum 10. A paddle device in the bottom of the drum 10 may be used instead of the fins 21 for stirring the cooling medium and causing it to circulate around the container.

The drum 10 may be connected to the turntable 11 by means other than the lug and slot connection described, for example, taper fit means or interengaging dimples in the drum 10 and the turntable 11 may be adopted.

A battery powered DC motor may be used in place of the mains powered AC motor in portable apparatus for use in boats, caravans, trains etc.

I claim:

1. A method of cooling a beverage contained in a container comprising the steps of providing a means for rotating a receptacle (10), supporting said receptacle on said means for rotating said receptacle, providing a support means for supporting said container in a fixed position within said receptacle filled with a cooling medium and imparting a swirling motion to said cooling medium by rotating the receptacle about the container, whereby said beverage may be cooled without disturbing same within said container.

2. A method of cooling a beverage contained in a container according to claim 3 in which the cooling medium is a mixture of ice and water.

3. A method of cooling a beverage contained in a container according to claim 3 further comprising supporting the container out of contact with the rotating receptacle.

4. A method of cooling a beverage contained in a container according to claim 1 comprising the further step of cooling the beverage in the container to a temperature in the region of about 9° C.

5. A method of cooling a beverage contained in a container according to claim 1, in which said step of supporting the container is effected by support means adapted to engage a neck portion of the container.

6. An apparatus for cooling a beverage contained in a container comprising at least one rotatable receptacle for containing a cooling medium, support means arranged to hold the container in a fixed position in the receptacle, and motion inducing means for rotating said receptacle which is operable upon the cooling medium to cause the cooling medium to swirl around the container continually circulating within the receptacle.

7. An apparatus for cooling a beverage contained in a container according to claim 6, including timing means for stopping said swirling motion after a predetermined period of time has elapsed.

8. An apparatus for cooling a beverage contained in a container comprising at least one rotatable receptable having an inner wall and being adapted to contain a cooling medium, and support means arranged to hold the container in a fixed position in the receptacle, the inner wall of said receptacle including motion inducing means operable upon the cooling medium to cause the cooling medium to swirl within said receptacle around the container upon rotation of the receptacle.

9. An apparatus for cooling a beverage contained in a container according to claim 8, in which said motion inducing means comprises at least one fin projecting into the receptacle and spaced from said container.

10. An apparatus for cooling a beverage contained in a container according to claim 8 in which said support means is adapted to hold a plurality of containers.

* * * * *